US006084343A

United States Patent [19]

Van De Poel et al.

[11] Patent Number: 6,084,343

[45] Date of Patent: Jul. 4, 2000

[54] DISPLAY DEVICE COMPRISING AN ANTI-STATIC, ANTI-REFLECTION FILTER AND A METHOD OF MANUFACTURING AN ANTI-REFLECTION FILTER ON A CATHODE RAY TUBE

[75] Inventors: Angela C.L. Van De Poel; Jurgen P.A. Heymbeeck; Brit Meier; Johannes M.A.A. Compen; Gustaaf H.A. Van Der Hoorn, all of Eindhoven, Netherlands

[73] Assignee: U.S. Philips Corporation, New York, N.Y.

[21] Appl. No.: 09/065,968

[22] Filed: Apr. 24, 1998

[30] Foreign Application Priority Data

Apr. 28, 1997 [EP] European Pat. Off. ..... 97201276
Oct. 14, 1997 [EP] European Pat. Off. ..... 97203199

[51] Int. Cl.[7] ..... H01J 31/00

[52] U.S. Cl. ..... 313/478; 313/479

[58] Field of Search ..... 313/478, 479, 313/477 R, 110, 112

[56] References Cited

U.S. PATENT DOCUMENTS

| | | | |
|---|---|---|---|
| 4,785,217 | 11/1988 | Matsuda et al. | 313/479 |
| 5,652,477 | 7/1997 | Tong et al. | 313/479 |
| 5,789,854 | 8/1998 | Takizawa et al. | 313/478 |

FOREIGN PATENT DOCUMENTS

| | | |
|---|---|---|
| 0531996A1 | 3/1993 | European Pat. Off. . |
| 0585819A1 | 3/1994 | European Pat. Off. . |

*Primary Examiner*—Nimeshkumar D. Patel
*Assistant Examiner*—Joseph Williams
*Attorney, Agent, or Firm*—Norman N. Spain

[57] ABSTRACT

A display window of a display device is provided with an anti-static, anti-reflection filter. Said filter comprises a conductive layer including metal particles and transparent particles, which layer is covered with a further transparent layer. The metal particles are responsible for the conduction which is preferably below 1000 ohm, and the transparent particles are responsible for the transmission of light. The assembly of the conductive layer and the transparent cover layer has a very low reflection, preferably below 1%.

10 Claims, 5 Drawing Sheets

DISPLAY DEVICE COMPRISING AN ANTI-STATIC, ANTI-REFLECTION FILTER AND A METHOD OF MANUFACTURING AN ANTI-REFLECTION FILTER ON A CATHODE RAY TUBE

BACKGROUND OF THE INVENTION

The invention relates to a display device comprising an anti-static, anti-reflection filter on a display window, and to a method of manufacturing a display device comprising an anti-reflection filter on a display window.

Such filters are provided on the display window of a display device, for example on cathode ray tubes or on the display window of a plasma display panel (PDP). These filters generally comprise a conductive layer. This conductive layer has an anti-static effect and, depending on the conductance, provides an effective shield, that is, the intensity of the electromagnetic alternating field emitted by the display device is reduced by the provision of the conductive transparent layer.

A display device and a method of manufacturing an anti-reflection filter on a display device are disclosed in WO 95/29501. In this Application, a description is given of a method in which a sol/gel coating of ITO (indium tin oxide, i.e. a layer containing $SnO_{2/In2}O_3$), which is applied to the window of a cathode ray tube, is cured in a hydrogen-containing atmosphere by means of a laser.

Preferably, the reflection and the electric resistance of the anti-reflection filter are low. A reduction of the reflection results in an improvement of the daylight contrast of the display device. A reduction of the resistance leads to an improvement of the shielding effect of the filter.

SUMMARY OF THE INVENTION

It is an object of the invention to provide a display device of the type mentioned in the opening paragraph, comprising a filter enabling a low reflection and a good shielding effect to be achieved.

To achieve this, the display device in accordance with the invention is characterized in that the anti-reflection filter comprises a conductive layer which includes metallic particles and transparent regions, and in that a further transparent layer is applied to this conductive layer.

The replacement of conductive, transparent layers made of semiconductors (for example ITO or ATO as in the prior art) by a layer comprising metallic particles and transparent regions, enables a good conductance and good optical properties to be achieved. The structure of said layer is such that a substantial part of the layer is transparent and that conduction takes place via contact between the metallic particles. The conductance or, in other terms, the surface resistance has a metallic character and is far less governed by external factors than semiconductors. The surface resistance can be reduced to values below 1000 ohms. The reflection is reduced compared to a known cathode ray tube having an equal number of filter layers.

Preferably, the metal particles comprise a metal of the group formed by silver, palladium, ruthenium, rhodium, gold or platinum. These metals are fairly neutral in color and exhibit a low degree of reactivity. Preferably, the layer comprises silver particles (Ag) and the conductive layer comprises a corrosion inhibitor. Silver is a suitable material, but corrosion of silver occurs relatively easily. Corrosion of the silver particles leads to the formation of a silver-oxide layer or silver-salt layer on the outside of the silver particles.

These layers increase the resistance between the silver particles and hence the resistance of the conductive layer. The addition of inhibitors to the conductive layer, for example in the form of metal particles in the layer which are separate from the silver particles, or as a layer which covers at least a part of the silver particles, or as an addition to the silver particles, causes the corrosion of the silver particles to be reduced. Corrosion inhibitors are, inter alia, the metals palladium (Pd), ruthenium (Ru), rhodium (Rh), gold (Au), platinum (Pt) and lead (Pb). A reduced corrosion of the silver particles leads to a smaller variation in electric resistance of the filter.

Preferably, the transparent particles comprise a material of the group formed by ITO (Indium-Tin Oxide), ATO (Antimony-doped Indium-Tin Oxide), $SiO_2$ and $TiO_2$.

Preferably, the metallic regions comprise particles having an average size (d1) below 20 nm (d1<20 nm) and above 1 nm (d1>1 nm).

Metallic particles which are larger than 20 nm have the disadvantage that coagulation of a number of regions causes the formation of a reflecting surface which leads to an increase in reflection. Metallic regions smaller than 1 nm exhibit a reduced conductance.

Preferably, the transparent regions have an average size (d2) which is at least twice the size of the metal particles (d2>2d1).

If the transparent regions are smaller (d2<2d1), there is a risk that the transparent regions become locally covered with metallic regions, which gives the impression that the surface is stained. Preferably, the thickness of the conductive layer (d3) is less than 1.5 times d2 (d3<1.5d2). A larger thickness of the first layer makes it difficult to form transparent regions, and generally leads to an increase in reflection.

A further problem which was not solved by the known display device or the known method, nor by methods of applying conductive layers to display devices in general, relates to the instability of the raw materials used and/or the instability of the surface resistance of the anti-static filter.

Sol/gel solutions as used in the known method are generally instable and perishable. This means that very great care must be observed in the preparation, storage and processing of the solutions and that, preferably, a relatively small supply of said solutions should be stocked, and the sol/gel solution has to be prepared at a short distance from the device used to carry out the method, and the time period between the manufacture and the use of said sol/gel solution should be as short as possible. Such conditions have a substantial cost-increasing effect, and there is a great risk that, despite due care, the solution and hence the conductive layer do not meet the quality requirements.

The method in accordance with the invention is characterized in that a solution of colloidal metal particles is provided on the display window and dried, whereafter a second transparent layer is applied. Such colloidal solutions are more stable than sol-gel solutions. The stability of the resistance of anti-static, anti-reflection filters manufactured in accordance with the method is improved.

Preferably, the solution of colloidal metal particles also comprises particles of a transparent material. Said colloidal metal particles assemble around the transparent particles, so that a conductive, transparent layer containing metal particles and transparent regions can readily be formed.

DETAILED DESCRIPTION OF THE INVENTION

Figure 1:
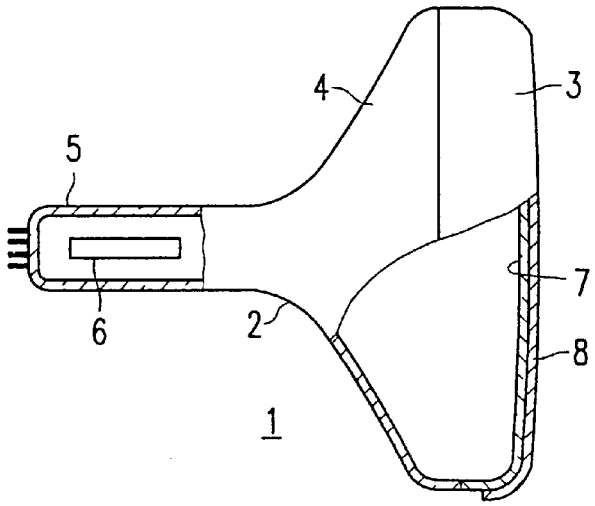
FIG. 1 shows a cathode ray tube.

The invention will now be described in greater detail with reference to the figures of the drawing.

The Figures are diagrammatic and not drawn to scale and, in general, like reference numerals refer to like parts.

FIG. 1 is a schematic cut-away view of a cathode ray tube 1 with a glass envelope 2 which comprises a display window 3, a cone 4 and a neck 5. In said neck, there is provided an electron gun 6 for generating an electron beam. This electron beam is focussed on a phosphor screen 7 on the inside of the display window 3. In operation, the electron beam is deflected across the phosphor screen 7 in two mutually perpendicular directions by means of a deflection coil system (not shown). The outer surface of the display window 3 is provided with an anti-static, anti-reflection filter 8 in accordance with the invention.

Figure 2:
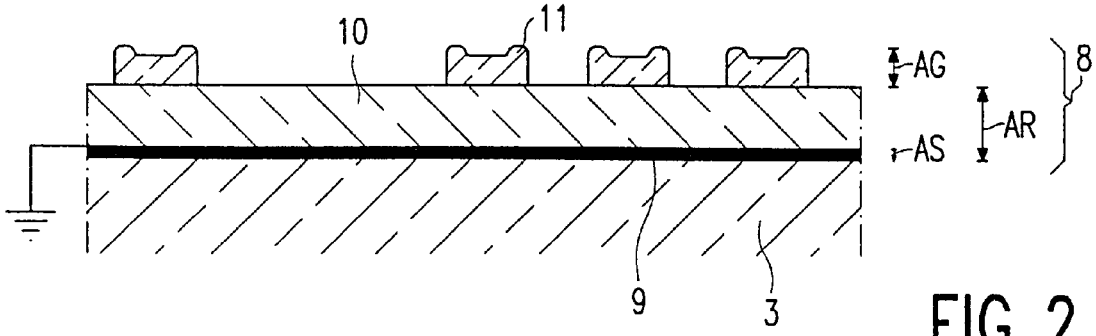
FIG. 2 is a sectional view of a display window provided with an anti-static, anti-reflection filter.

FIG. 2 is a sectional view of a display window 3 provided with an anti-static, anti-reflection filter 8. Said filter comprises a conductive layer 9 (AS) which is provided on the display window 3 and which is covered with a transparent layer 10, said layers jointly forming an ARAS (Anti-Static, Anti-Reflection) layer. In this example, the second, transparent layer 10 is covered with an anti-glare layer 11 in order to suppress glare.

Figure 3:
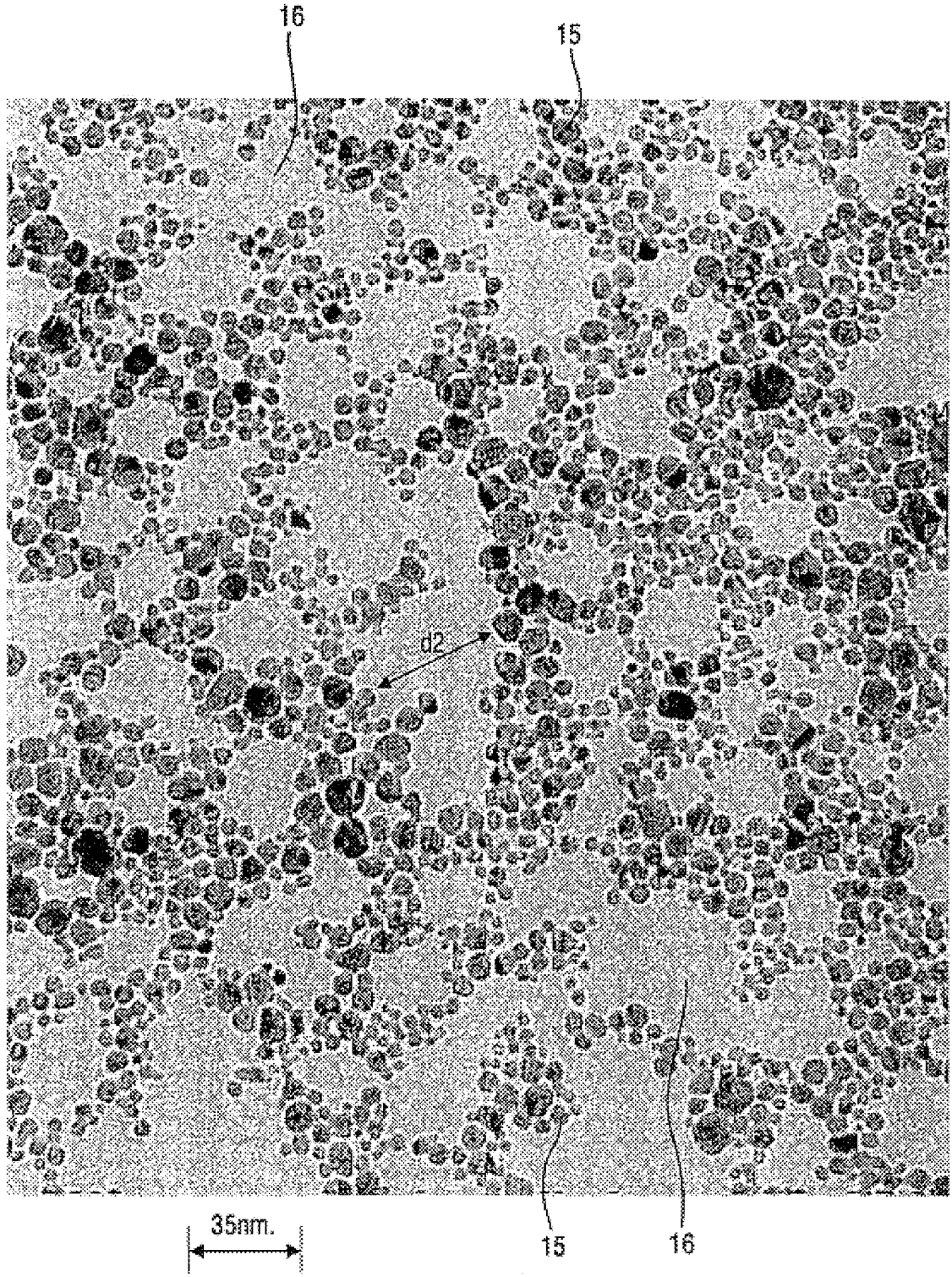
FIG. 3 is a plan view of a SEM photograph of a conductive layer.

FIG. 3 shows a SEM photograph of a first, conductive layer 9. Said layer 9 comprises metallic particles (dark particles 15) enclosing transparent regions 16.

The metallic particles 15 have an average size (d1) in the range from 2–8 nm. The transparent regions have an average size of 20–35 nm. The metallic particles 15 make contact with each other and thus provide for electric conduction, and they enclose the transparent regions 16. The structure formed can be referred to as a soap-bubble structure, in which the transparent "bubbles" are situated in a sea of metal particles making contact with each other. The transparent regions 16 are responsible for the transmission of light, and electric conduction is brought about by the contacts between the metal particles 15. Preferably, the average size of the metallic particles is below 20 nm and above 1 nm. The average size of the transparent regions is preferably more than twice that of the metallic particles. The thickness of the conductive layer 9 does not exceed 1.5 times the average size of the transparent regions.

EXAMPLE 1

A solution of colloidal silver (0.1–5 g) in ethanol-water (100 g) is prepared. The solution is made, for example, by means of the so-called Carey Lea sol-preparation process.

Using the following starting solutions:

A: 400 g/l $Na_3$ citrate.$2H_2O$

B: 300 g/l $FeSO_4.7H_2O$

C: 100 g/l $AgNO_3$ 700 ml of a solution A is mixed with 500 ml of a solution B 500 ml of a solution C is added to this mixture, while stirring, whereafter the resultant mixture is centrifuged (4000 rpm, 30 minutes), after which the sediment formed during centrifuging is dispersed in 1 liter water, whereafter 1 liter of solution A is added, leading to the formation of a sediment this sediment is dispersed in 1 liter water dispersal and sedimentation are repeated 3×, and the eventual precipitate is dispersed in 1 liter water.

The resultant solution of silver in water may be diluted in ethanol or methanol. The diluted solution is subsequently provided on a surface of the display device and dried, thereby forming a layer 9 containing metal particles 15.

The silver concentration in the solution determines the conductive and transmissive properties of the layer containing metal particles.

A relatively high silver concentration results in a low transmission in combination with an excellent conductance; a relatively low silver concentration results in a high transmission in combination with a poor conductance.

The following table lists, by way of illustration, the surface resistance (in Ohm/square) as a function of the ratio Ag-solution (having a solids content of 2.5% ) ethanol (abbr. AG:EtOH), as well as observations about the transmission.

| ratio AG:EtOH: | surface resistance | observations |
|---|---|---|
| 2:1 | 53 | very low transmission |
| 1:1 | 110 | low transmission |
| 1:1,5 | 146 | transmission 68% |
| 1:2 | 680 | |
| 1:3 | 3600 | very high transmission |

The SEM photograph shown in FIG. 3 shows a layer which corresponds to a ratio of AG:EtOH of 1:1.5. To improve the dispersion, a silane component (for example Dow Corning Z 6032) may also be added to the solution. The solution is provided on the outer surface of a display window, for example by means of spin coating, and subsequently dried. The particle size of the colloidal silver particles is approximately 2–8 nm. The resultant layer containing metal particles is provided with a second layer. This second layer covers the layer containing metal particles and fills the transparent regions 16 between the metal particles. For this purpose, for example, a hydrolyzed TEOS (Tetra-Ethyl-Orthosilicate) solution is applied to layer 9 containing metal particles, for example, by means of spin coating. The standard TEOS solution proved to be unsatisfactory because the conductance decreased considerably and the coating as such had a dull appearance. This can probably be attributed to the fact that the metal of the metal particles is partly converted to AgCl, which is an insulator, by $Cl^-$ ions (in the standard solution, HCl is used for the hydrolysis of the TEOS solution). The TEOS solution (or more generally each solution from which the second layer is made) is preferably free of halogenides (such as Cl, Br, I). For example, a hydrolyzed TEOS (tetraethyl orthosilicate) solution is provided on the conductive layer by means of spin coating, and dried (5 g of TEOS and 2.5 g of $HNO_3$ in 92 g of ethanol).

Subsequently, in some embodiments, an anti-glare TEOS layer may be sprayed onto the second layer in order to preclude glare. The layers thus provided are subsequently cured by exposure to heat (160° C. for 30 minutes).

EXAMPLE 2

A solution of colloidal silver in ethanol-water is prepared as described in example 1. Transparent particles (for example ATO or preferably $SiO_2$) having dimensions of approximately 20–40 nm are added to the solution.

The volume ratio of metal particles:transparent particles (for example Ag:$SIO_2$, but also other particles) ranges preferably between 1:0.8 and 1:9. A smaller volume ratio causes the transmission of the filter to become so low that the intensity of the image displayed is reduced excessively.

Figure 4:
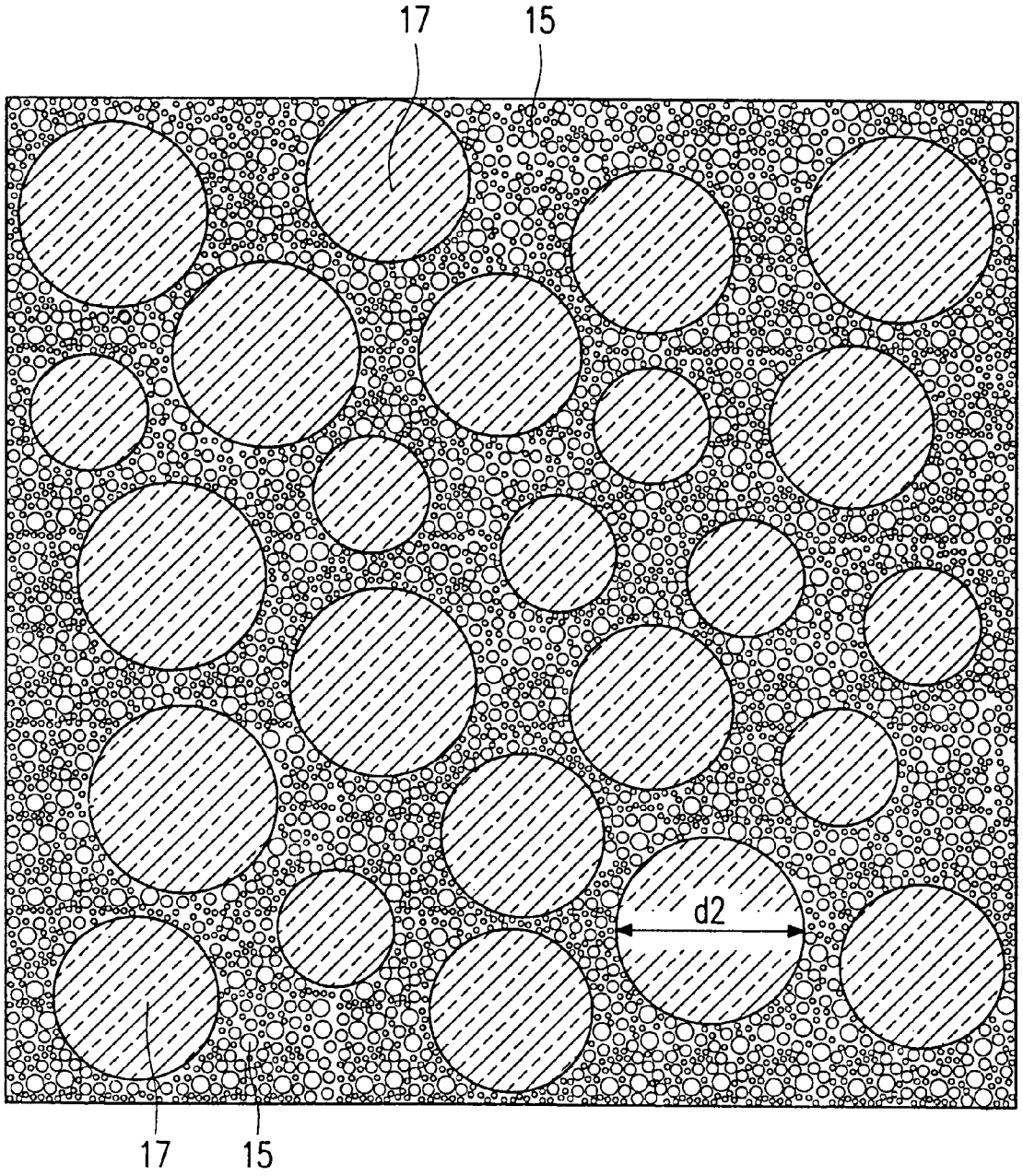
FIG. 4 is a schematic plan view of a further example of a conductive layer.

A larger volume ratio leads to a high resistance value. Preferably, the volume ratio ranges between 1:2 and 1:5. By mixing transparent particles into the solution, the ratio of metal particles to transparent regions in the conductive layer can be controlled more readily. The colloidal metal particles assemble around the transparent particles so that a conductive, transparent layer containing metal particles 15 and transparent regions 16 can be readily formed. FIG. 4 schematically shows a conductive layer 9 comprising metal particles (15), having an average diameter d1, and transparent particles (17) having an average diameter d2. Subsequently, as described in example 1, such a layer is provided with a further transparent layer.

EXAMPLE 3

A colloidal solution is prepared as described in example 1, with this difference that the solution C is formed by C: 100 g/l{$xAgNO_3$+$yRNO_3(H_2O)$} in other words, solution C comprises, in addition to silver nitrate, a nitrate of a metal R, where R is palladium, platinum, gold, rhodium or ruthenium. The value of y preferably ranges between 0.01 (1%) and 0.70 (70%). Thus, the conductive layer does not only comprise silver particles but also palladium, platinum, gold, rhodium or ruthenium. The presence of these metals in the conductive layer reduces the corrosion of the silver. As a result, a more stable resistance of the conductive layer is obtained.

EXAMPLE 4

A conductive layer is made as described in example 1. Prior to the application of the TEOS-solution, the conductive layer is provided with a solution of a salt (for example a nitrate solution) of palladium, platinum, rhodium, gold, ruthenium or lead. Silver dissolves partly in the solution and a layer of a noble metal or lead at least partly covers the silver particles. The presence of these metals in the conductive layer protects the silver against corrosion. As a result, a more stable resistance of the conductive layer is obtained.

Just as in example 1, when the further transparent layer is applied to the conductive layer, it is preferably free of halogenides. The acidity and hence the stability, for example, of TEOS solutions are customarily controlled by adding hydrochloric acid (HCl). However, the use of halogenides or halogen compounds in the second layer has a negative effect on the resistance (exhibits an increase), on the stability of the resistance (exhibits a greater variation) and on the optical properties. This is the reason why, in this example, $HNO_3$ is used in the TEOS solution.

The surface resistance of the anti-static, anti-reflection filter formed in accordance with the examples ranged between 100 and 1000 ohm, for example 600 ohm, the transmission exceeded 65% and the reflection was below 20% of the original reflection (4,5%). For comparison, it is noted that in known cathode ray tubes, the surface resistance is substantially higher and ranges from $10^4$ to $10^{10}$ ohm.

Figure 5:
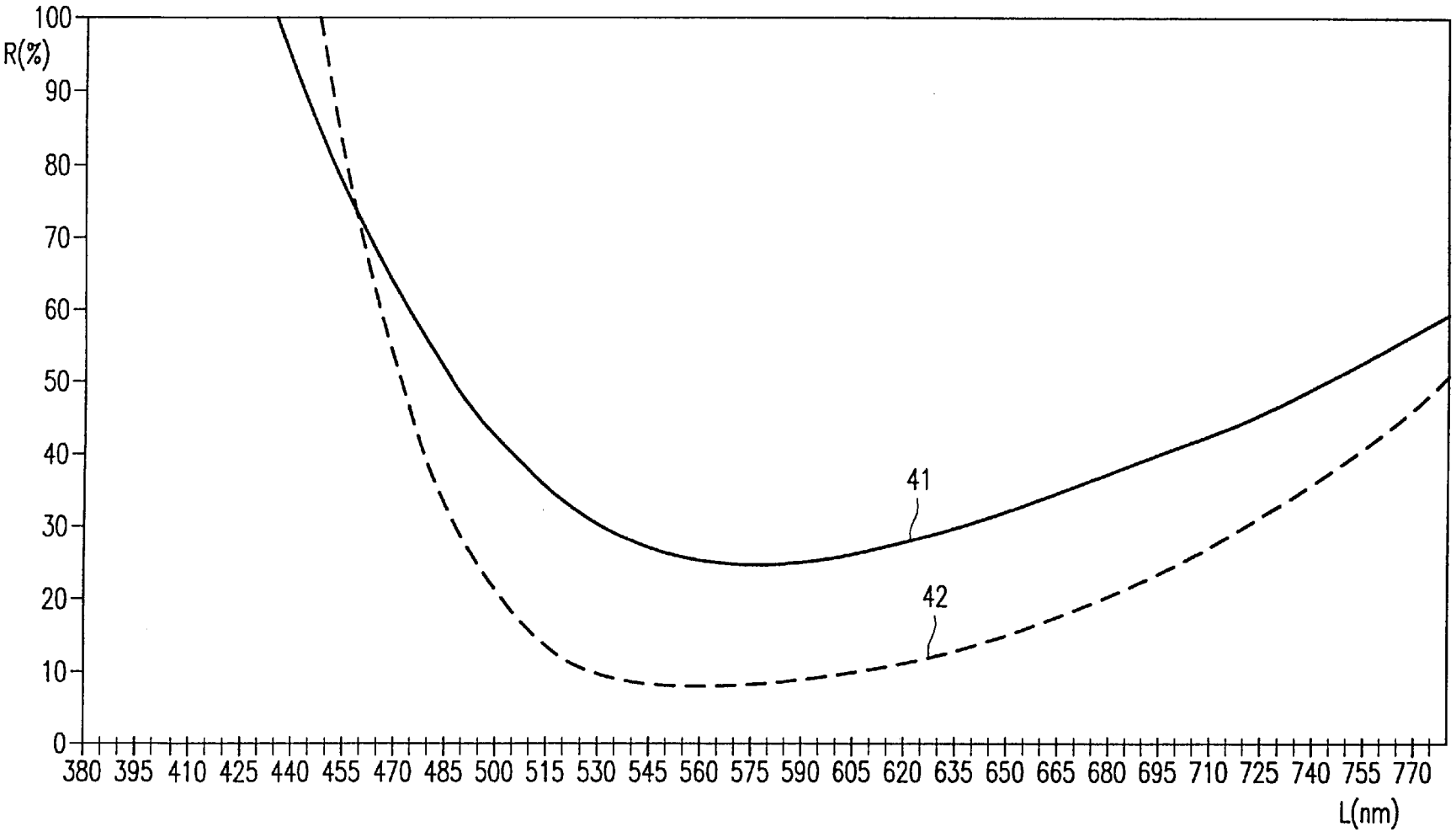
FIG. 5 graphically shows the measured reflection of two double-layer anti-static, anti-reflection filters on a cathode ray tube.

FIG. 5 graphically shows the reflection R (in percent with respect to a cathode ray tube without a filter) as a function of the wave-length L (in nm) for two filters. Line 41 indicates the reflection for a double-layer anti-static, anti-reflection, anti-glare filter whose first layer contains ATO and whose second layer contains $SiO_2$. Line 42 indicates the reflection of a double-layer filter manufactured as described in example 1. The reflection is considerably lower at almost all wavelengths in the visible spectrum of light. The reflection coefficient has a minimum value below 1%, in this example approximately 0.3%. The addition of metal particles in a concentration which is sufficient to obtain electric conduction in the filter via the metal particles apparently also has a substantial positive effect on the optical properties of the filter, in particular the reflection is substantially reduced (in this example by a factor of 2 to 3). The transmission of the anti-static, anti-reflection filter in accordance with the invention is generally lower than that of the known filter. However, this is an advantage rather than a disadvantage. Customarily, dark glass is used in a cathode ray tube (having, for example, a transmission of 50%) to increase the contrast. As the transmission of the filter in a cathode ray tube in accordance with the invention is below 100%, use can be made of a type of glass which is lighter in color (for example a type of glass having a transmission of 70%). This has the advantage that, in the case of a variation in the thickness of the glass, the transmission of light across the display screen of the cathode ray tube is more uniform. In general, the thickness of the display window 3 is not uniform, but increases from the center of the display window towards the edges of the display window. An increase in thickness of 10% is not unusual. As a result, the absorption of the glass and the variation in thickness of the display window towards the edges of the display window causes the brightness of the image displayed to decrease. The use of glass which is lighter in color (transmission above 60%) leads to a reduction of this adverse effect. In embodiments of the display device in accordance with the invention, the transmission of the display window without the filter is more than 60%, and the overall transmission of the display window with the filter is less than 50%.

Figure 6:
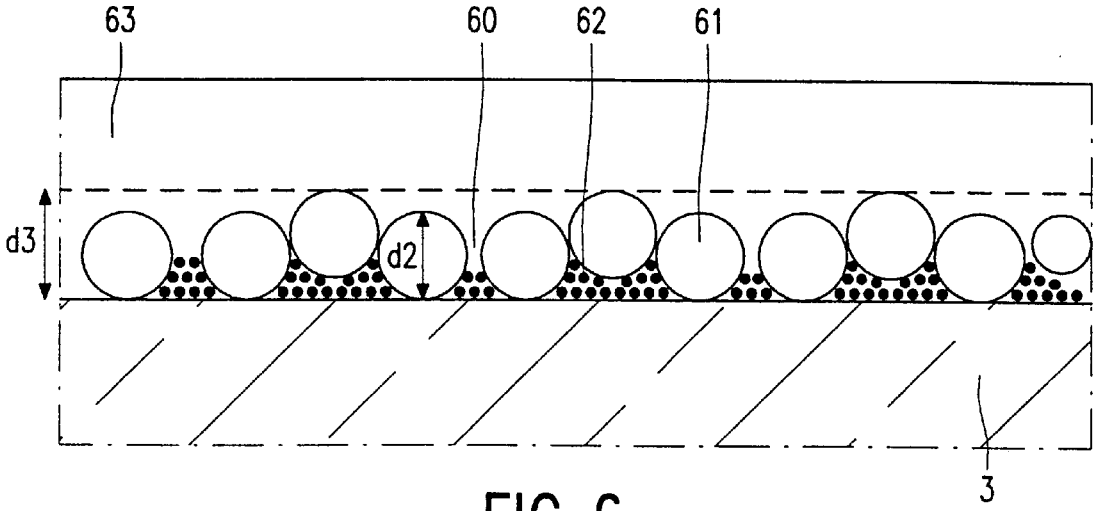
FIG. 6 is a sectional view of a display window provided with a conductive layer.

FIG. 6 is a sectional view of a conductive layer 60 on a display window 3. The conductive layer 9 comprises transparent regions 61 and metal particles 62. The average size of the metal particles (d1, not indicated in the Figure) is smaller than the average size of the transparent regions (d2). The metal particles 62, which are smaller than the transparent regions, fill the "holes" between transparent regions 61 and contact each other around the transparent regions (see also FIGS. 3 and 4), thereby providing for electric conduction. The thickness of the conductive layer (d3) is indicated in the Figure. The thickness of the conductive layer 9 preferably does not exceed 1.5 times d2. The layer 60 is covered with a transparent layer 63.

Figure 7A:
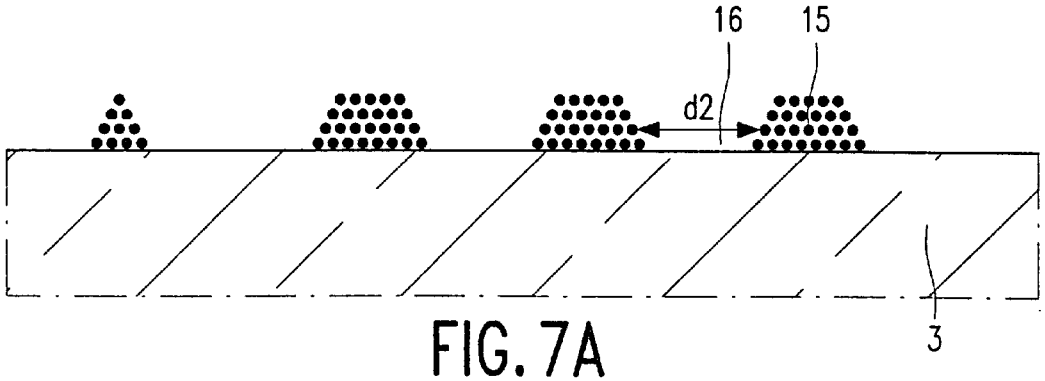
FIGS. 7A and 7B are illustrations of an embodiment of the method in accordance with the invention.
Figure 7B:
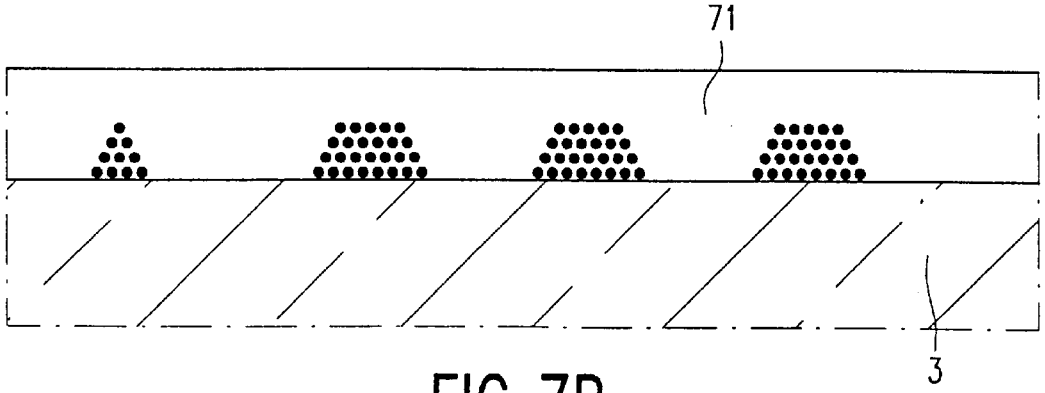

FIGS. 7A and 7B illustrate an embodiment of the method in accordance with the invention. FIG. 7A is a sectional view of a display window on which conductive particles 15 are provided which leave the transparent regions 16 uncovered (for a plan view see FIG. 3). Subsequently, (FIG. 7B), a transparent layer 71 is provided thereon. Said layer 71 covers the conductive particles and also fills the transparent regions 16.

It will be obvious that, within the scope of the invention, many variations are possible to those skilled in the art. The invention is described by means of an example in which the display device is a cathode ray tube. Although the invention is important, in particular, for cathode ray tubes because the shielding effect of the anti-static filter is important for said tubes in particular, the invention is not limited thereto. The invention is also important for other types of display devices, such as LCDs and plasma displays. The invention can advantageously be used, in particular, for plasma displays (PDPs) and plasma-controlled LCDs (PALC). In such devices, plasma discharges take place and an image is reproduced. As a result of the discharges, static charge may accumulate on the display window and electromagnetic stray fields may be generated. In the example described herein, the conductive layer is applied directly onto the display window. This is a preferred embodiment. However, the invention is not limited thereto. In embodiments, further transparent layers may be situated between the conductive layer and the display device.

The invention can be summarized as follows:

A display window of a display device is provided with an anti-static, anti-reflection filter. Said filter comprises a conductive layer including metal particles and transparent particles, which layer is covered with a further transparent layer. The metal particles are responsible for the conduction which is preferably below 1000 ohm, the transparent particles are responsible for the transmission of light. The assembly of the conductive layer and the transparent cover layer has a very low reflection, preferably below 1%.

We claim:

1. A display device comprising an anti-reflection filter on a display window, characterized in that the anti-reflection filter comprises a conductive layer which includes metallic particles and transparent regions, and in that a further transparent layer is applied to said conductive layer.

2. A display device as claimed in claim 1, characterized in that the metal particles comprise a metal of the group consisting of silver, palladium, ruthenium, rhodium, gold and platinum.

3. A display device as claimed in claim 2, characterized in that the layer comprises silver particles (Ag) and a corrosion inhibitor.

4. A display device as claimed in claim 1, characterized in that the conductive layer comprises metal particles having an average size (d1) below 20 nm (d1<20 nm) and above 1 nm.

5. A display device as claimed in claim 1, characterized in that the transparent regions have an average size (d2) which is at least twice the size of the metal particles (d2>2d1).

6. A display device as claimed in claim 1, characterized in that the thickness (d3) of the conductive layer is less than 1.5 times the average size of the transparent regions.

7. A display device as claimed in claim 1, characterized in that the transparent regions are formed by particles of a transparent material.

8. A display device as claimed in claim 7, characterized in that the volume ratio of metal particles: transparent particles in the conductive layer ranges between 1:0.8 and 1:9.

9. A method of manufacturing a display device provided with an anti-reflection filter, characterized in that a solution of colloidal metal particles is provided on the display window and dried, whereafter a further transparent layer is applied and fixed.

10. A method as claimed in claim 9, characterized in that the solution is a colloidal solution of metal particles containing a metal of the group consisting of silver (Ag), palladium (Pa), ruthenium (Ru), rhodium (Rh), gold (Au) and platinum (Pt).

* * * * *